US009739010B2

(12) United States Patent
Long et al.

(10) Patent No.: US 9,739,010 B2
(45) Date of Patent: Aug. 22, 2017

(54) PHASE-TRANSFER CATALYTIC COLOUR FIXATION PROCESSING METHOD FOR TEXTILE

(71) Applicant: Soochow University, Suzhou, Jiangsu (CN)

(72) Inventors: Jiajie Long, Suzhou (CN); Hongmei Xu, Suzhou (CN); Chuanglong Cui, Suzhou (CN); Feng Chen, Suzhou (CN); Xiaochen Wei, Suzhou (CN)

(73) Assignee: Soochow University, Suzhou (CN)

( * ) Notice: Subject to any disclaimer, the term of this patent is extended or adjusted under 35 U.S.C. 154(b) by 37 days.

(21) Appl. No.: 14/915,771

(22) PCT Filed: Sep. 3, 2013

(86) PCT No.: PCT/CN2013/082832

§ 371 (c)(1),
(2) Date: Mar. 1, 2016

(87) PCT Pub. No.: WO2015/032020

PCT Pub. Date: Mar. 12, 2015

(65) Prior Publication Data

US 2016/0230335 A1 Aug. 11, 2016

(51) Int. Cl.

| | |
|---|---|
| ***D06P 3/00*** | (2006.01) |
| ***D06P 3/66*** | (2006.01) |
| ***D06P 1/38*** | (2006.01) |
| ***D06P 1/94*** | (2006.01) |
| ***D06P 1/16*** | (2006.01) |
| ***D06P 1/66*** | (2006.01) |
| ***D06P 1/673*** | (2006.01) |
| ***D06P 3/60*** | (2006.01) |

(52) U.S. Cl.

CPC ..... *D06P 3/66* (2013.01); *D06P 1/16* (2013.01); *D06P 1/38* (2013.01); *D06P 1/66* (2013.01); *D06P 1/6735* (2013.01); *D06P 1/94* (2013.01); *D06P 3/6033* (2013.01)

(58) Field of Classification Search

CPC .. D06P 1/38; D06P 1/16; D06P 1/6735; D06P 1/94; D06P 3/66; D06P 3/6033

See application file for complete search history.

(56) References Cited

FOREIGN PATENT DOCUMENTS

| | | |
|---|---|---|
| CN | 1310257 A | 8/2001 |
| CN | 102392367 A | 3/2012 |

(Continued)

OTHER PUBLICATIONS

English translation (Jun. 1, 2017) of the Patent No. CN102392367.*

*Primary Examiner* — Eisa Elhilo
(74) *Attorney, Agent, or Firm* — SZDC Law P.C.

(57) ABSTRACT

A phase-transfer catalytic color fixation processing method for textile includes the following steps: (1) dry-dyeing a textile with disperse reactive dyes in supercritical carbon dioxide fluid under waterless condition; (2) putting the textile in a phase-transfer catalytic fixation device, taking phase-transfer catalyst as the carrier of circulated supercritical carbon dioxide fluid, transporting the ionized fixing catalytic alkaline substance from aqueous phase to hydrophobic supercritical carbon dioxide fluid phase, getting full contact with functional groups on fibers, resulting in the fixing catalytic reaction with disperse reactive dyes.

5 Claims, 2 Drawing Sheets

(56) References Cited

FOREIGN PATENT DOCUMENTS

| | | | |
|---|---|---|---|
| CN | 102817194 | A | 12/2012 |
| JP | 2004300588 | A | 10/2004 |
| JP | 419418 | B2 | 12/2008 |

* cited by examiner

PHASE-TRANSFER CATALYTIC COLOUR FIXATION PROCESSING METHOD FOR TEXTILE

This application is a PCT National Stage Application of PCT/CN2013/082832, filed on Sep. 3, 2013, which is incorporated by reference for all purposes as if fully set forth herein.

TECHNICAL FIELD

The present invention relates to a processing method of phase-transfer catalytic fixation on the textiles. More particularly, it relates to a processing method of phase-transfer catalytic fixation in supercritical carbon dioxide fluid using disperse reactive dyes for textiles, especially for natural-fibre textiles, belonging to the field of textile dyeing and finishing technology.

BACKGROUND ART

As one of the main industrial waste water discharger, traditional textile printing and dyeing industry is not only having high water resource consumption, but also producing a lot of wastewater. The wastewater produced by printing and dyeing is with complex and changeable composition, deep chromaticity, high COD value, and often contains a variety of toxic and harmful substances, which would pollute the fresh water resource and do harm to the ecological environment. Instead of dyeing with traditional water-bath, adopting and promoting the anhydrous ecological textile dyeing process in which supercritical carbon dioxide fluid is employed, has the characteristics of ecological effects, environmental protection and clean production, which facilitating the upgrading of traditional textile printing and dyeing industry and breaking through the bottleneck problem such as restricted by water and sewage. It is of far-reaching significance.

However, there are technical problems need to be solved of dyeing and fixing on textiles made of natural-fibres such as cotton, silk, wool, and the like, in supercritical carbon dioxide fluid. Due to the hydrophobicity of supercritical carbon dioxide fluid, it is greatly limited in the application of traditional ionic or high polarity dyes or/and auxiliaries. Additionally, hydrophilic fibres cannot be sufficiently wetted and swollen in hydrophobic supercritical carbon dioxide fluid. Therefore, the adsorption of dyes on fibres and diffusion of dyes in fibres are affected markedly. In recent years, many researchers have adopted different means or methods, and carried out extensive research in this field (cross-referenced the literatures: Dyeing of modified cotton fibres with disperse dyes from supercritical carbon dioxide Lewis J Soc Dyers Colour 114 5/6 (1998), pp. 169-173; Dyeing natural fibres with disperse dyes in supercritical carbon dioxide. Text Res J. 64 7(1994), pp. 371-374; Dyeing wool without water—possibilities and limits of supercritical $CO_2$. In: Wenclawiak B, Padberg S, editors. 4th International symposium extraction for sample preparation-SFE-(X) SE-SPME-Book of abstracts 1999. Siegen: University GH of Siegen; 1999. p. 29-30; Modifying with TCT on silk and dyeing in supercritical carbon dioxide [J]. Silk, 2005(7):32-34). Existing technical researches and practices show that disperse reactive dyes which are structure-optimized can realize textile dyeing in supercritical carbon dioxide fluid. In particular, it is one of the feasible and effective ways to realize natural-fibre textiles dyeing and fixing (cross-referenced the literatures: Dyeing of cotton fabric with a disperse reactive dye in supercritical carbon dioxide, The journal of supercritical fluids, 2012, 69: 13-20; Solubility of disperse reactive dye in supercritical carbon dioxide, Colouration technology, 2012, 128: 127-132). As the parent structure of the dye has the hydrophobic properties of disperse dye, the problem of solubility of dyes in supercritical carbon dioxide fluid is solved effectively. At the same time, hydrophilic fibres can also get better adsorption and diffusion of dyes in the dry state without pretreatment such as wetting because the structure of the optimized dye is small. With certain conditions, the active groups in the dyes can react with the functional groups on fibres, so that dyes are connected with fibres by covalent bonds and fixed, greatly improving the colour fastness of the dyeing products.

However, because of the weak acidity of supercritical carbon dioxide fluid, the dyeing process of textiles, especially the dyeing and fixing of natural-fibre textiles is difficult to perform. Therefore, in order to improve the fixation efficiency, reduce the reaction temperature of fixation and shorten the processing time, etc., how to improve the reactivity of various functional groups on fibres in supercritical carbon dioxide fluid has very important significance.

CONTENT OF THE INVENTION

The purpose of the present invention is to overcome the shortage of prior art and provide an effective processing method of textile dyeing and fixing in supercritical carbon dioxide fluid, especially for the natural-fibre textiles dyed by disperse reactive dyes.

A phase-transfer catalytic colour fixation processing method for textile, comprising the following steps:

1. Dry-dyeing with disperse reactive dyes on textiles in waterless supercritical carbon dioxide fluid;

2. Put the textiles into the phase-transfer catalytic fixation device, and take phase-transfer catalyst as the carrier of circulated supercritical carbon dioxide fluid, then the ionized fixing catalytic alkaline substance is transported from aqueous phase to hydrophobic supercritical carbon dioxide fluid phase, getting a good contact with functional groups on fibres, resulting in the fixing catalytic reaction with disperse reactive dyes. Ionized fixing catalytic alkaline substance is selected from sodium hydroxide, sodium carbonate and sodium phosphate, or the substances that can produce hydroxyl by hydrolysis or thermal decomposition in the environment with a small amount of water. The concentration of said fixing catalytic alkaline substance is 0.1 g/L~20 g/L. Said phase-transfer catalyst is perfluorooctyl quaternary ammonium salt, or quaternary ammonium salt with $C_{12}$~$C_{18}$ aliphatic chain or aryl group.

The active group of said disperse reactive dyes is selected from vinyl sulfone, ethenyl, triazine, nicotinic acid, or their derivatives.

In a preferred solution, the process of dry-dyeing on textiles in supercritical carbon dioxide fluid under anhydrous medium condition has the system pressure of 8.0~30.0 MPa, temperature ranging at 40° C.~100° C. and processing time for 30~180 min.

In a preferred solution, the conditions of catalytic fixation reaction are temperature ranging at 60° C.~160° C., pressure at 8.0~30.0 MPa and time of reaction for 20~180 min.

To realize said phase-transfer catalytic fixation processing method for textiles, a phase-transfer catalytic fixation device is used, which consists of the system of supercritical carbon dioxide fluid, fixing liquid storage tank and fixing reactor, wherein the fixing liquid storage tank is below the fixing reactor, and they are sealed connected by connecting device. Fixing liquid storage tank has a cylindrical cavity, in which there's a fluid distributor. Said fluid distributor is composed of several interconnected pipes, which bending down with the nozzles downward, and one of the pipes is used as circulated fluid inlet, connecting with said supercritical carbon dioxide fluid system, and the rest pipes are used as circulated fluid outlets. Said fixing reactor has a cylindrical cavity, with a circulated fluid outlet on the top, connecting with said supercritical carbon dioxide fluid system; moreover, a porous filter is installed at the bottom of the reactor, and the lower part of fluid diversion cover is horn shaped, covering at the top of the porous filter, and the top port of the fluid diversion cover is connecting with the opposite port of textile winding shaft. Said textile winding shaft is a cylindrical hollow shaft, whose top port is closed and holes are set on the cylinder.

With the above technical solution, the present invention has the following beneficial effects: due to the utilization of mechanism of phase transfer catalysis in the fixation system, when textiles, particularly the natural-fibre textiles, dyed and fixed by disperse reactive dyes in supercritical carbon dioxide fluid, alkaline accelerants that only can exist in the polar aqueous solution may also come into the hydrophobic fluid phase, and then react with the functional groups on the solid-phase fibres, which improving the reactivity of functional groups on fibres with dyes and increasing the dye catalytic fixation efficiency on fibres ultimately. Simultaneously, the process can reduce the temperature of fixing reaction and shorten the processing time. Thus, this invention has a broad application prospect in the aspect of textiles waterless dyeing and fixing process in the supercritical carbon dioxide fluid, especially for the natural-fibre textiles.

BRIEF DESCRIPTION OF THE DRAWINGS

In FIG. 1: 1. Circulated fluid inlet; 2. Fixing liquid storage tank; 3. Fixing mixture; 4. Fluid distributor; 5. Filter; 6. Connecting device; 7. Fluid diversion cover; 8. Textile winding shaft; 9. Fixing reactor; 10. Textile winded; 11. Circulated fluid outlet.

DETAILED DESCRIPTION OF THE EMBODIMENTS

The present invention will be further described below with reference to drawings and embodiments.

EXAMPLE 1

In the process of textile phase transfer catalytic fixation provided by present invention, the textile adopted is a woven cotton fabric (102.0 g/m$^2$) in dry state; the dye adopted is disperse reactive red (containing a active group of ethenyl, provided by Everlight Chemical Industrial Corporation, Taiwan, 0.2% o.m.f).

The phase transfer catalytic fixation device and the process provided by this invention can refer to China invention patent whose public number is CN102296469A named "the dyeing method of natural fibres in supercritical carbon dioxide fluid".

Figure 1:
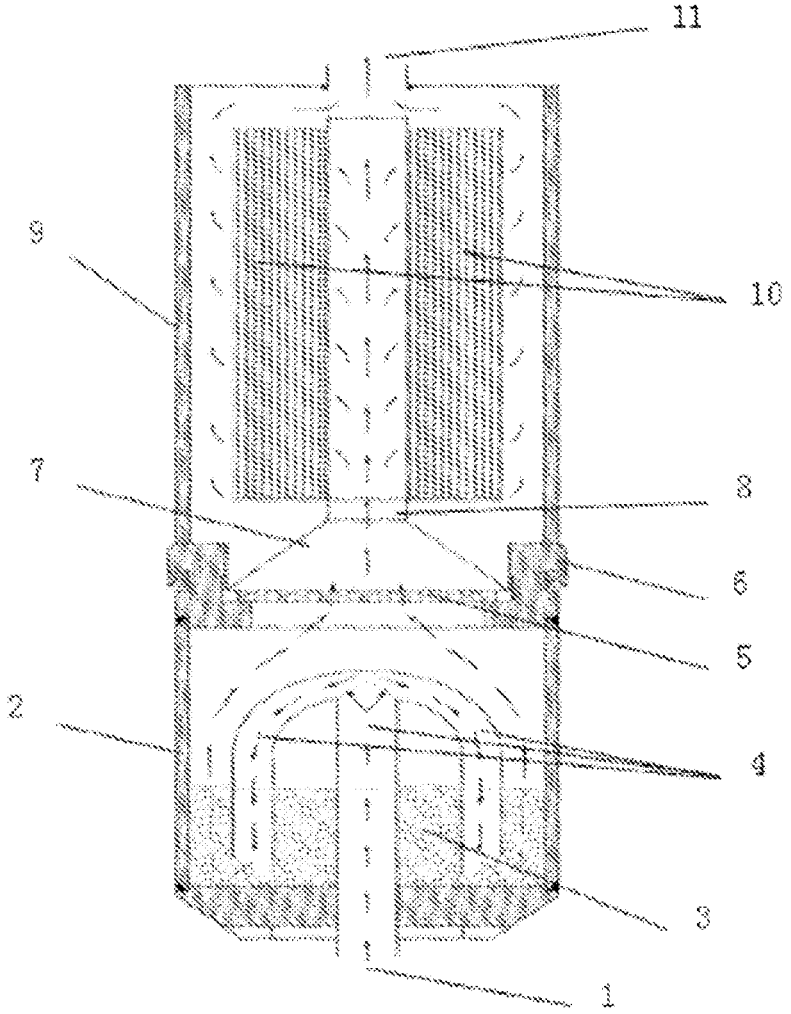
FIG. 1 is a schematic of the device of textile phase-transfer catalytic fixation in supercritical carbon dioxide fluid of one embodiment of this invention.

Refer to FIG. 1, it's the schematic of the device of textile phase transfer catalytic fixation in supercritical carbon dioxide fluid. It's consist of fixing liquid storage tank, fixing reactor and supercritical carbon dioxide fluid treatment system possessing a circulation pump, but the circulating pump is omitted in the figure. Fixing liquid storage tank 2 is cylindrical cavity, building in fluid distributor 4 which is tube shaped like the inverted "mountain". The fluid distributor 4 is consist of three interconnected pipes which bending down, two of them are circulated fluid outlet, and pipe located in the center is the circulated fluid inlet 1, connecting with supercritical carbon dioxide fluid system through the lower port of the fixing liquid storage tank. Fixing liquid storage tank and fixing reactor 9 are connected by connecting device as a whole. Fixing reactor is cylindrical cavity, filter 5 and fluid diversion cover 7 horn shaped are installed at the bottom, and there is a circulated fluid outlet 11 on the top. In the fixing reactor, there is a textile winding shaft 8 which winding the textiles to be processed, and its lower port is opening, connecting with the fluid diversion cover; on the contrary, the top port is closed but opens a roller hole. The material of shaft body is teflon or non-thermal conductivity material, or its internal and external surface material is teflon or non-thermal conductivity material. Fixing liquid storage tank and fixing reactor are connected to the system of supercritical carbon dioxide fluid through the circulated fluid inlet and outlet. In the process, fixing mixture 3 is added to the fixing liquid storage tank, the nozzle of circulated fluid outlet pipeline in fluid distributor is placed in the solution, and the textiles 10 to be processed in loose state are evenly wrapped around the shaft. In present example, the filter is single layer or multi-layer plate material filled with 50~2000 mesh micro-porous. Put the dyed textiles which dyed by disperse reactive dyes into the fixing reactor, and assemble textiles winding shaft, fluid diversion cover and filter on the basis of FIG. 1. At the same time, add the mixture (the solid content of 10%; $n(Na_2CO_3)$: n((FC-134)=1:3) of fixation accelerants ($Na_2CO_3$) and phase transfer catalyst (FC-134) of 5.50 g to the fixing liquid storage tank. Afterwards, fixing liquid storage tank and fixing reactor are sealed connected by connecting device. In the condition of system pressure about 20 MPa and temperature about 100° C., the circulated supercritical carbon dioxide fluid comes into the fixing mixture through circulated fluid inlet and fluid distributor from bottom to top, and the fixation accelerant in the solution enter the phase of supercritical carbon dioxide fluid with the transportation of phase transfer catalyst. Then the fixation accelerant companied by fluid enter the textile winding shaft after passing through the filter and fluid diversion cover, and contact with fabric material along with mass transfer when the fabric layer is penetrated, which making the transferred alkaline accelerant react with functional groups on the fibres such as hydroxyl. Thus, the reactivity of nucleophilic reaction of active groups is improved, and the fixation reaction is facilitated and catalyzed. Finally, the fluid which penetrates into the fabric layer, completes the mass transfer and flows from the circulated fluid outlet, comes into the next cycle of circulation. Fluid circulation alternates with static, and the treatment time ratio is of 1:10. Relief pressure after treating the textiles with phase transfer catalytic fixation reaction in fixing reactor as long as 60 min, and recycle the carbon dioxide and residual fixation catalyst in the system. Meanwhile, in the case of the other conditions unchanged, the experiment of no fixation accelerant ($Na_2CO_3$) and phase transfer catalyst (FC-134) is performed as a blank control one. Furthermore, the cotton fabrics completing the dye fixation are used for analysis and testing of dye fixation.

Figure 2:
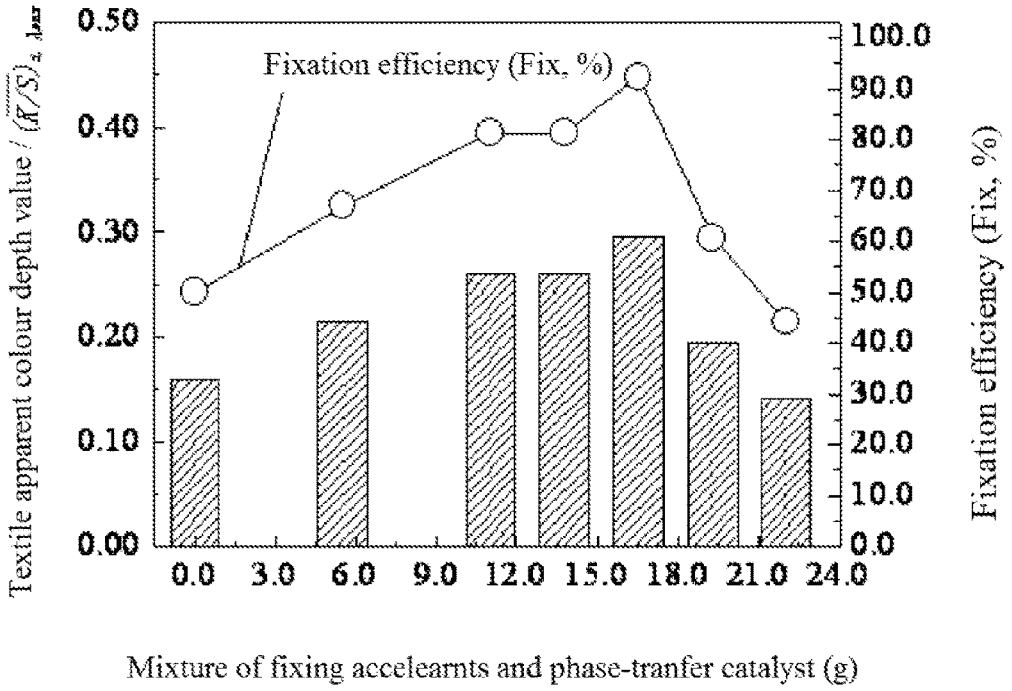
FIG. 2 is a diagram about comparison of the influence of the dosage of the mixture (the solid content is 10%; $n(Na_2CO_3)$:n((FC-134)=3:1) of fixing accelerants ($Na_2CO_3$) and phase-transfer catalyst (FC-134) to textile apparent colour depth value $(\overline{K/S})_{1,\lambda\ max}$ and fixation efficiency (Fix, %) in supercritical carbon dioxide fluid.

With reference to the steps and process above, analysis of dye fixation about disperse reactive red on cotton fabrics and the testing results are as follows:

For the sake of the analysis of fixation ratio of dyes on fabric, acetone is adopted in the fat extractor in order to extract the floating colour which is unfixed on fixed cotton fabric under the condition of 81° C. for 30 min. Moreover, the ratio of apparent colour depth values (K/S) which are before and after extraction is utilized to evaluate the dye fixation on fabrics. Fix (%) is the fixation efficiency of dye on the fabric, and it is calculated by the equation below.

$$\text{Fix}(\%) = \frac{(\overline{K/S})_{1,\lambda\ max}}{(\overline{K/S})_{0,\lambda\ max}} \times 100\%$$

Wherein $$(\overline{K/S})_{1,\lambda\ max} = \frac{1}{n} \times \sum_{i=1}^{n} (K/S)_{i,\lambda\ max}$$

is the average of apparent colour depths value of the fabric sample after extraction (the arithmetic mean of the front end, side, in-middle-out on both sides of fabric; or named the fixation apparent colour depth value); n is the number of measurements (n=12 in this embodiment); $(\overline{K/S})_{1,\lambda\ max}$ refers to the apparent colour depths value (K/S) in i-times measurement at the maximum absorption wavelength ($\lambda_{max}$) measured by employing an Ultrascan PRO instrument (HunterLab. Co., Ltd., USA) in the 8-folded form of fabric sample. $(\overline{K/S})_{0,\lambda\ max}$ is the average of apparent colour depths of the fabric sample before extraction. FIG. 2 shows the result.

EXAMPLE 2

According to the device and process of phase-transfer catalytic fixation provided in example 1, 11.00 g of the mixture (with 10% of solid contents; n($Na_2CO_3$):n(FC-134)=3:1) of fixation accelerant ($Na_2CO_3$) and phase-transfer catalyst (FC-134) is added to the fixing liquid storage tank. The result refers to FIG. 2.

EXAMPLE 3

According to the device and process of phase-transfer catalytic fixation provided in example 1, 13.75 g of the mixture (with 10% of solid contents; n($Na_2CO_3$):n(FC-134)=3:1) of fixation accelerant ($Na_2CO_3$) and phase-transfer catalyst (FC-134) is added to the fixing liquid storage tank. The result refers to FIG. 2.

EXAMPLE 4

According to the device and process of phase-transfer catalytic fixation provided in example 1, 16.50 g of the mixture (with 10% of solid contents; n($Na_2CO_3$):n(FC-134)=3:1) of fixation accelerant ($Na_2CO_3$) and phase-transfer catalyst (FC-134) is added to the fixing liquid storage tank. The result refers to FIG. 2.

EXAMPLE 5

According to the device and process of phase-transfer catalytic fixation provided in example 1, 19.25 g of the mixture (with 10% of solid contents; n($Na_2CO_3$):n(FC-134)=3:1) of fixation accelerant ($Na_2CO_3$) and phase-transfer catalyst (FC-134) is added to the fixing liquid storage tank. The result refers to FIG. 2.

EXAMPLE 6

According to the device and process of phase-transfer catalytic fixation provided in example 1, 22.00 g of the mixture (with 10% of solid contents; n($Na_2CO_3$):n(FC-134)=3:1) of fixation accelerant ($Na_2CO_3$) and phase-transfer catalyst (FC-134) is added to the fixing liquid storage tank. The result refers to FIG. 2.

FIG. 2 shows that both of the fixation apparent colour depth value and fixation efficiency of disperse reactive red dye on the cotton fabric are low in the blank control experiment, with the fixation apparent colour depth value and fixation efficiency at 0.16 and 50% respectively. Additionally, the fixation apparent colour depth value $(\overline{K/S})_{1,\lambda\ max}$ and fixation efficiency are notably increased with the application of the mixture of fixation accelerant ($Na_2CO_3$) and phase-transfer catalyst (FC-134) in the system of fixation, accompanying with the maximum fixation apparent colour depth value and fixation efficiency at 0.296 and 92.4% respectively, as the dosage of the mixture at 16.5 g, showing an obvious fixation effect of phase-transfer catalysis. But the fixation apparent colour depth value $(\overline{K/S})_{1,\lambda\ max}$ and fixation efficiency are decreased if the dosage of the mixture keeps on increasing, which probably due to the breakage of the bonds or hydrolysis resulted by the alkaline accelerant with excess mixture in the system of fixation. In addition, it is also found in the process of experiment that the moisture rate is higher on the fixed fabric when the dosage of mixture is overdosed, and the colour becomes shallow significantly when the fabric is touched by the mixture.

EXAMPLE 7

According to the device and process of phase-transfer catalytic fixation provided in example 1, the system pressure is 8.0 MPa and temperature is 140° C. 11.00 g of the mixture (with 10% of solid contents; n($Na_2CO_3$):n(FC-134)=3:1) of fixation accelerant ($Na_2CO_3$) and phase-transfer catalyst (FC-134) is added to the fixing liquid storage tank (2). The result shows in table 1.

Table 1 is the result of disperse reactive red dye (0.2% o.m.f) on cotton woven fabric performed as phase-transfer catalytic fixation process provided by present example.

TABLE 1

| The condition of phase transfer catalytic reaction | $(\overline{K/S})_{0,\lambda max}$ λmax = 480 nm | $(\overline{K/S})_{1,\lambda max}$ λmax = 480 nm | Fix (%) (fixation efficiency) |
|---|---|---|---|
| 8 MPa × 140° C. × 60 min | 0.320 | 0.225 | 70.3 |

Table 1 shows that, a good dyeing effect is obtained for disperse reactive red dye on the dry cotton woven fabric in supercritical carbon dioxide fluid, and with the help of phase transfer catalyst in the low-pressure supercritical carbon dioxide fluid which is in near critical state, fixation accelerant can facilitate the fixation reaction of functional groups on fibres with dyes and improve the fixation apparent colour depth value $(\overline{K/S})_{1,\lambda\ max}$ and fixation efficiency.

EXAMPLE 8

According to the device and process of phase-transfer catalytic fixation provided in example 1, the system pressure is 20.0 MPa and temperature is 160° C. 11.00 g of the mixture (with 10% of solid contents; $n(Na_2CO_3)$: n(FC-134)=3:1) of fixation accelerant ($Na_2CO_3$) and phase-transfer catalyst (FC-134) is added to the fixing liquid storage tank (2). The result shows in table 2.

Table 2 is the result of disperse reactive red dye (0.2% o.m.f) on cotton woven fabric performed as phase-transfer catalytic fixation process provided by present example.

TABLE 2

| The condition of phase transfer catalytic reaction | $(\overline{K/S})_{0,\lambda max}$ λmax = 480 nm | $(\overline{K/S})_{1,\lambda max}$ λmax = 480 nm | Fix (%) (fixation efficiency) |
|---|---|---|---|
| 20 MPa × 160° C. × 60 min | 0.320 | 0.219 | 68.4 |

Table 2 indicates that with the help of phase-transfer catalyst, fixation accelerant also can get in touch with the fabric, facilitating the fixation reaction of functional groups on fibres with active groups of dyes, and improve the fixation apparent colour depth value $(\overline{K/S})_{1,\lambda\ max}$ and fixation efficiency when the dry cotton woven fabric is dyed by disperse reactive red in supercritical carbon dioxide fluid with the condition of higher pressure and temperature.

EXAMPLE 9

According to the device and process of phase-transfer catalytic fixation provided in example 1, the system pressure is 12.0 MPa and temperature is 140° C. 16.50 g of the mixture (with 10% of solid contents; $n(Na_2CO_3)$: n(FC-134)=3:1) of fixation accelerant ($Na_2CO_3$) and phase-transfer catalyst (FC-134) is added to the fixing liquid storage tank (2). Fixation processing for 40 min, 60 min and 100 min have been done respectively, and the treatment time ratio of fluid circulation alternating with static is 1:5. The result shows in table 3.

Table 3 is the result of disperse reactive red dye (0.2% o.m.f) on cotton woven fabric with different times of phase transfer catalytic fixation process provided by present example.

TABLE 3

| The time of phase transfer catalytic reaction (min) | $(\overline{K/S})_{0,\lambda max}$ λmax = 480 nm | $(\overline{K/S})_{1,\lambda max}$ λmax = 480 nm | Fix (%) (fixation efficiency) |
|---|---|---|---|
| 40 min | 0.320 | 0.222 | 69.4 |
| 60 min | 0.320 | 0.308 | 96.3 |
| 100 min | 0.320 | 0.310 | 96.9 |

Table 3 depicts that dyeing with phase-transfer catalytic reaction in supercritical carbon dioxide fluid, the fixation apparent colour depth value $(\overline{K/S})_{1,\lambda\ max}$ and fixation efficiency of disperse reactive red dye on dry cotton woven fabric are improved effectively. With the conditions adopted in present example, the fixation apparent colour depth value $(\overline{K/S})_{1,\lambda\ max}$ can reach 0.222, and fixation efficiency is up to 69.4% when the time of phase-transfer catalytic fixation treatment is 40 min. Moreover, the fixation apparent colour depth value $(\overline{K/S})_{1,\lambda\ max}$ is enhanced markedly, and the fixation efficiency can be more than 96% along with the time of catalytic fixation extended to 60 min or 100 min.

From the fixation effect of example 1 to example 9, it is indicated that textiles dyed by disperse reactive dyes, especially the natural-fibre textiles such as cotton, when using phase-transfer catalysis in fixing stage, accelerant in the fixing mixture comes into the hydrophobic fluid phase along with mass transfer with the fabric; as a consequence, the reactivity of functional groups on fibres is improved so as to facilitate the fixing reaction of dyes and fibres, and also effectively improve the apparent colour depth value $(\overline{K/S})_{1,\lambda\ max}$ and fixation efficiency (Fix,%). Comparing to prior art, the present invention can notably improve the nucleophilic reactivity of functional groups on fibres in hydrophobic supercritical carbon dioxide, and has the advantages of improving the fixation efficiency of disperse reactive dyes on textiles, shortening the processing time and so on, even with simple process and easy operation. Consequently, it has a broad application prospect.

What is claimed is:

1. A phase-transfer catalytic colour fixation processing method for textile, characterized in that it comprises the following steps:

(1) dry-dyeing a textile with disperse reactive dyes in supercritical carbon dioxide fluid under waterless condition;

(2) putting the textile in a phase-transfer catalytic fixation device, taking phase-transfer catalyst as the carrier of circulated supercritical carbon dioxide fluid, transporting the ionized fixing catalytic alkaline substance from aqueous phase to hydrophobic supercritical carbon dioxide fluid phase, getting full contact with functional groups on fibres, resulting in the fixing catalytic reaction with disperse reactive dyes, Wherein said ionized fixing catalytic alkaline substance is sodium hydroxide, sodium carbonate, sodium phosphate, or substances that can produce hydroxyl by hydrolysis or thermal decomposition in the environment with a small amount of water, the concentration of said fixing catalytic alkaline substance is 0.1 g/L~20g/L, and said phase-transfer catalyst is perfluorooctyl quaternary ammonium salt, or quaternary ammonium salt with $C_{12}$~$C_{18}$ aliphatic chain or aryl group.

2. The phase-transfer catalytic colour fixation processing method according to claim 1, wherein the active group of said disperse reactive dyes is selected from vinyl sulfone, ethenyl, triazine, nicotinic acid, or their derivatives.

3. The phase-transfer catalytic colour fixation processing method according to claim 1, wherein the processing conditions of dry-dyeing on textile in said supercritical carbon dioxide fluid with anhydrous condition are, the system pressure is 8.0~30.0 MPa, temperature ranging at 40° C.~100° C., and processing time is 30~180 min.

4. The phase-transfer catalytic colour fixation processing method according to claim 1, wherein the conditions of catalytic fixation reaction are, temperature ranging at 60° C.~160° C., the pressure is 8.0~30.0 MPa, time of reaction is 20~180 min.

5. The phase-transfer catalytic colour fixation processing method according to claim 1, wherein said phase-transfer catalytic fixation device consists of a supercritical carbon dioxide fluid system, a fixing liquid storage tank and a fixing reactor, said fixing liquid storage tank is below said fixing reactor and sealed connected by connecting device, said fixing liquid storage tank has a cylindrical cavity, in which fluid distributor is set, said fluid distributor is composed of several interconnected pipes which bending down with the nozzles downward, and one of the pipes is used as circulated fluid inlet, connected with said supercritical carbon dioxide fluid system, and the rest pipes are used as circulated fluid outlets, said fixing reactor has a cylindrical cavity, with a circulated fluid outlet on the top and connected with said supercritical carbon dioxide fluid system; a porous filter is installed at the bottom of the reactor, and the lower part of a fluid diversion cover is horn shaped, covering at the top of the porous filter, and the top port of the fluid diversion cover is connected with the opposed port of textile winding shaft, said textile winding shaft is a cylindrical hollow shaft, whose top port is closed and holes are set on the cylinder.

* * * * *